US005718174A

United States Patent [19]

Friedrichs et al.

[11] Patent Number: 5,718,174

[45] Date of Patent: Feb. 17, 1998

[54] CLAMPING AND PULLING DEVICE FOR CYLINDER PACKINGS IN A PRINTING PRESS

[75] Inventors: Jens Friedrichs, Heidelberg; Bernd Ruf, Weiterstadt, both of Germany

[73] Assignee: Heidelberger Druckmaschinen AG, Heidelberg, Germany

[21] Appl. No.: 786,846

[22] Filed: Jan. 22, 1997

[30] Foreign Application Priority Data

Jan. 22, 1996 [DE] Germany ..... 196 02 104.9

[51] Int. Cl.[6] ..... B41F 1/28

[52] U.S. Cl. ..... 101/415.1

[58] Field of Search ..... 101/415.1, 378, 101/409, 382.1

[56] References Cited

U.S. PATENT DOCUMENTS

| | | | |
|---|---|---|---|
| 2,764,089 | 9/1956 | Bachman | 101/415.1 |
| 4,304,182 | 12/1981 | Etchell et al. | 101/415.1 |
| 4,836,103 | 6/1989 | Komori et al. . | |
| 4,938,134 | 7/1990 | Dörsam et al. | 101/415.1 |
| 5,184,534 | 2/1993 | Merkel et al. | 101/415.1 |
| 5,339,738 | 8/1994 | Blaser et al. . | |
| 5,359,933 | 11/1994 | Blaser et al. | 101/415.1 |
| 5,440,989 | 8/1995 | Becker | 101/415.1 |
| 5,596,928 | 1/1997 | Marmin et al. | 101/378 |

FOREIGN PATENT DOCUMENTS

| | | |
|---|---|---|
| 35 38 308 C2 | 5/1986 | Germany . |
| 43 26 250 C2 | 2/1995 | Germany . |
| 484 204 | 5/1938 | United Kingdom . |
| 2 167 011 A | 5/1986 | United Kingdom . |

*Primary Examiner*—Eugene H. Eickholt
*Attorney, Agent, or Firm*—Herbert L. Lerner; Laurence A. Greenberg

[57] ABSTRACT

A clamping and pulling device for cylinder packings in a printing press, the device having gripper elements disposed in a cylinder gap extending axially at a circumference of a cylinder, and power elements for actuating the gripper elements to grip and firmly hold an end of a respective packing extending around an edge defining the gap and into the gap and, when actuated by the power elements, for pulling the cylinder packing around the edge defining the gap into the gap, includes abutments on the cylinder, the gripper elements being formed of two clamping bars having respective opposing clamping jaws braced against the abutments, respectively, and, in an angular position defined by the abutments on the cylinder and the arrangement of the clamping jaws at a bent-away portion of the cylinder packing, being disposed with a vertex directed opposite to a tensioning direction, tensioning forces of a respective power element serving to load at least one of the clamping bars in the direction of a mutually extended position of the two clamping bars.

8 Claims, 3 Drawing Sheets

CLAMPING AND PULLING DEVICE FOR CYLINDER PACKINGS IN A PRINTING PRESS

BACKGROUND OF THE INVENTION

Field of the Invention

The invention relates to a clamping and pulling device for cylinder packings in a printing press, the device having gripper elements disposed in a cylinder gap extending axially at a circumference of a cylinder, and power elements for actuating the gripper elements to grip and firmly hold an end of a respective packing extending around an edge defining the gap and into the gap and, when actuated by the power elements, for pulling the cylinder packing around the edge defining the gap into the gap.

According to the published German Patent Document DE 42 27 683 C2 which discloses such a heretofore known clamping and pulling device for a bent-away trailing edge of a printing plate on a plate cylinder of a sheet-fed rotary printing press, clamping bars are disposed in a frame and, as a result of clamping forces, the jaw surfaces of the clamping bars are pressable against one another, the frame being movably guided in the cylinder gap radially with respect to the cylinder axis, the clamping slit formed by the jaw surfaces of the clamping bars being movable outwardly with the radially outer limitation thereof, at least, up to the circumferential outline or contour of the cylinder cross-section and being movable backwardly with the clamped bent-away portion of the trailing edge of the printing plate within the outline or contour of the plate cylinder, in order thereby to exert a pulling effect upon the printing plate. With this heretofore known arrangement, both clamping bars are supported against one another on the frame and thus on the plate cylinder, with an adjusting element acting upon a clamping rail so that clamping forces are exerted on the clamping jaws, and with two further adjusting elements causing tensioning forces to be exerted on the frame in the circumferential direction of the plate cylinder. Moreover, an additional press-on roller is required to mount the plate so that it lies flat on the cylinder. Thus, such a clamping and pulling device requires a relatively great technical effort or expense.

SUMMARY OF THE INVENTION

It is accordingly an object of the invention to provide a low-cost clamping and pulling device which is generally suitable for both leading and trailing edges of cylinder packings, and which permits a smooth contact between the bent-away portion of a packing and the edge defining a cylinder gap having a different radius, if necessary or desirable.

With the foregoing and other objects in view, there is provided, in accordance with one aspect of the invention, a clamping and pulling device for cylinder packings in a printing press, the device having gripper elements disposed in a cylinder gap extending axially at a circumference of a cylinder, and power elements for actuating the gripper elements to grip and firmly hold an end of a respective packing extending around an edge defining the gap and into the gap and, when actuated by the power elements, for pulling the cylinder packing around the edge defining the gap into the gap, comprising abutments on the cylinder, the gripper elements being formed of two clamping bars having respective opposing clamping jaws braced against the abutments, respectively, and, in an angular position defined by the abutments on the cylinder and the arrangement of the clamping jaws at a bent-away portion of the cylinder packing, being disposed with a vertex directed opposite to a tensioning direction, tensioning forces of a respective power element serving to load at least one of the clamping bars in the direction of a mutually extended position of the two clamping bars.

In accordance with another feature of the invention, the one clamping bar engages under the other clamping bar and is braced against a spring acting in a direction opposite to the direction in which the respective power element acts.

In accordance with a further feature of the invention, the one clamping bar has a hook-shaped cross section and has a hooklike tip with which the one clamping bar is braced against the other clamping bar at a side thereof located opposite one of the abutments, the hooklike tip embracing an edge of a border of the bent-away portion of the cylinder packing lying between respective surfaces of the clamping jaws.

In accordance with an added feature of the invention, the other clamping bar braced against the hook tip of the one clamping bar is loaded by a spring considerably weaker than the spring against which the one clamping bar is braced, the last-mentioned spring being disposed underneath the one clamping bar.

In accordance with an additional feature of the invention, the clamping and pulling device includes adjusting elements for movably disposing at least one of the two abutments in a direction opposite to the respective other abutment.

In accordance with yet another feature of the invention, the respective power element acting upon the one clamping bar is a tightening screw.

In accordance with a further aspect of the invention, there is provided a clamping and pulling device for cylinder packings in a printing press, the device having gripper elements disposed in a cylinder gap extending axially at a circumference of a cylinder, and power elements for actuating the gripper elements to grip and firmly hold an end of a respective packing extending around an edge defining the gap and into the gap and, when actuated by the power elements, for pulling the cylinder packing around the edge defining the gap into the gap, the gripper elements including a clamping bar subjectible to tensioning forces and rotatably mounted in a recess formed in the cylinder, the clamping bar having at least one projection at the circumference thereof for engaging, respectively, in at least one cutout formed in a bent-away portion of the cylinder packing and behind a projection of said bent-away portion in the tensioning direction, as the case may be, comprising a screw drive coupled with the clamping bar.

In accordance with a concomitant feature of the invention, the clamping bar has a round cross section, and the screw drive is formed of a worm transmission having a worm mounted in the cylinder so as to be rotatable by a tool, the worm transmission also having a worm wheel connected to the clamping bar.

A particular advantage of the device according to the invention is that, simultaneously with the clamping movement, a pulling movement is executed in the tensioning direction of the cylinder packing so that the cylinder packing which is passed around the edge defining the cylinder gap and has a curvature deviating from that of the edge radius is pulled towards the cylinder edge. The inventive features permit the packing to be pulled around the edge of the cylinder defining the gap. As a result thereof, a peripheral bead is prevented from being produced at the bent-away portion of the packing in the circumferential direction, because no air remains between the radius of the edge defining the cylinder gap and the radius of curvature of the bent-away portion of the packing.

The inventive solution of this objective is basically effected with one gripper element formed of a movably arranged clamping bar and a jaw surface stationarily provided in the cylinder gap.

A preferred embodiment includes two clamping bars.

A clamping and pulling device having these features is suited for printing plates, blankets, and other cylinder packings preferably provided in sheet-fed rotary printing presses. The device according to the invention may be used to clamp both the leading edge of the packing and the trailing edge of the packing and to simultaneously pull or apply tension to the ends of the packing. The construction of the device according to the invention requires only very little space and does not have any mechanisms which are susceptible to failure.

Other features which are considered as characteristic for the invention are set forth in the appended claims.

Although the invention is illustrated and described herein as embodied in a clamping and pulling device for cylinder packings in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
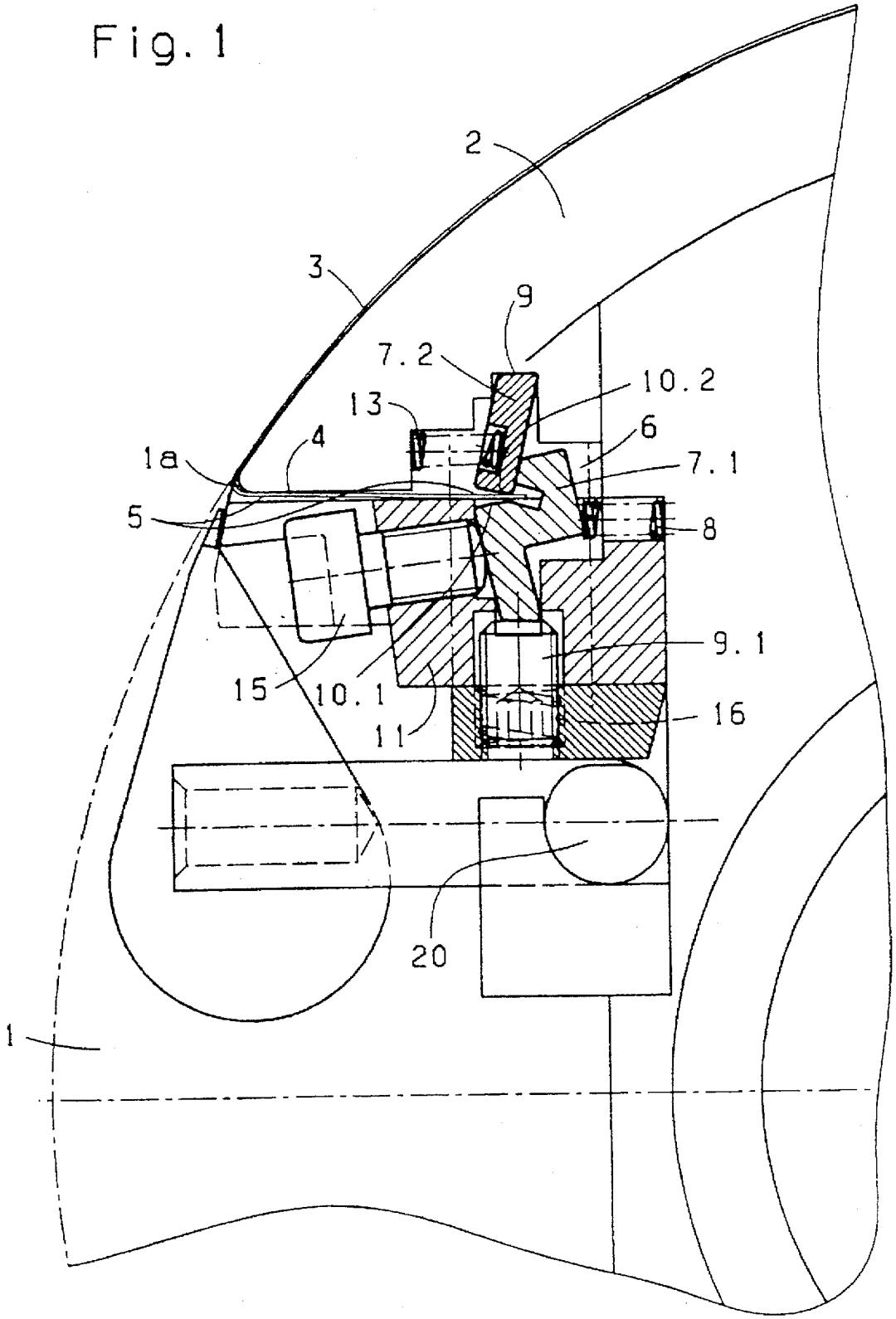
FIG. 1 is a fragmentary cross-sectional view of a specimen embodiment of a clamping and pulling device according to the invention disposed in a cylinder gap.

Referring now to the drawings and, first, particularly to FIG. 1 thereof, there is shown therein an embodiment of the clamping and pulling device according to the invention which is disposed in a gap 1 formed in a cylinder 2 of a printing press, preferably a sheet-fed rotary printing press, the gap 1 being open at the circumference or outer cylindrical surface of the cylinder 1 and extending in axial direction thereof. A packing 3 provided on the cylinder circumference or outer cylindrical surface has, at a leading edge thereof, a bent-away portion 4 engaging in a conventional manner in a clamping slit 5 formed in the cylinder 2. Two clamping bars 7.1 and 7.2 are disposed in a recess 6 formed in the cylinder gap 1, one of the clamping bars 7.1 having a hook-shaped cross-section and resting with a cross-piece thereof on a spring 8. The other clamping bar 7.2 is supported on or braced against an abutment 9 formed by a defining surface of the recess 6. Clamping jaws 10.1 and 10.2 of the clamping bars 7.1 and 7.2 are in contact on mutually opposing sides thereof with an inner end of the bent-away portion 4 of the packing 3. With the end of the one clamping bar 7.1 lying opposite the clamping jaw 10.1, the one clamping bar 7.1 is supported on or braced against an abutment 9.1 movably mounted in the cylinder 2. Due to the abutment of the clamping bars 7.1 and 7.2 provided at the cylinder 2 and due to the contact of the clamping jaws 10.1 and 10.2 with the inner end of the bent-away portion 4, an angular position of the clamping bars 7.1 and 7.2 with respect to one another is defined, the vertex of the angle which is formed being directed opposite to the tensioning direction. One of the two clamping bars 7.1 and 7.2 is hook-shaped, when viewed in cross section, so that it embraces the inner edge of the bent-away portion 4 and engages under the clamping bar 7.2 to support it. A tightening screw 15 may be screwed in the internal screw thread of a rail 11 so that by means of said tightening screw 15 the two clamping bars 7.1 and 7.2 may be loaded in direction of their mutually extended position. As a result thereof, clamping forces act on the inner end of the bent-away portion 4, while simultaneously pulling forces act in the tensioning direction of the packing 3 so that the packing is pulled tightly around the edge 1*a* defining the gap 1, and air which might possibly be present under a curvature deviating from the radius of the edge 1*a* defining the gap 1 is forced out. In order that static friction between the jaw surface 10.2 of the clamping bar 7.2 and the bent-away portion 4 reliably occurs, the clamping bar 7.2 is loaded in the tensioning direction by a spring 13 which is considerably weaker than the spring 8. When the tightening screw 15 is loosened, the spring 8 presses the clamping bar 7.1 and therewith also the clamping bar 7.2 upwardly against the weaker spring 13 so that the jaw surfaces 10.1 and 10.2 release the inner end of the bent-away portion 4. If, in the case of a past dead-center position, the movable abutment 9.1 may be moved by any adjusting elements 16 in order to enlarge the angular position between the two clamping bars 7.1 and 7.2. Alternatively, this may be achieved by an eccentric 20.

Figure 2:
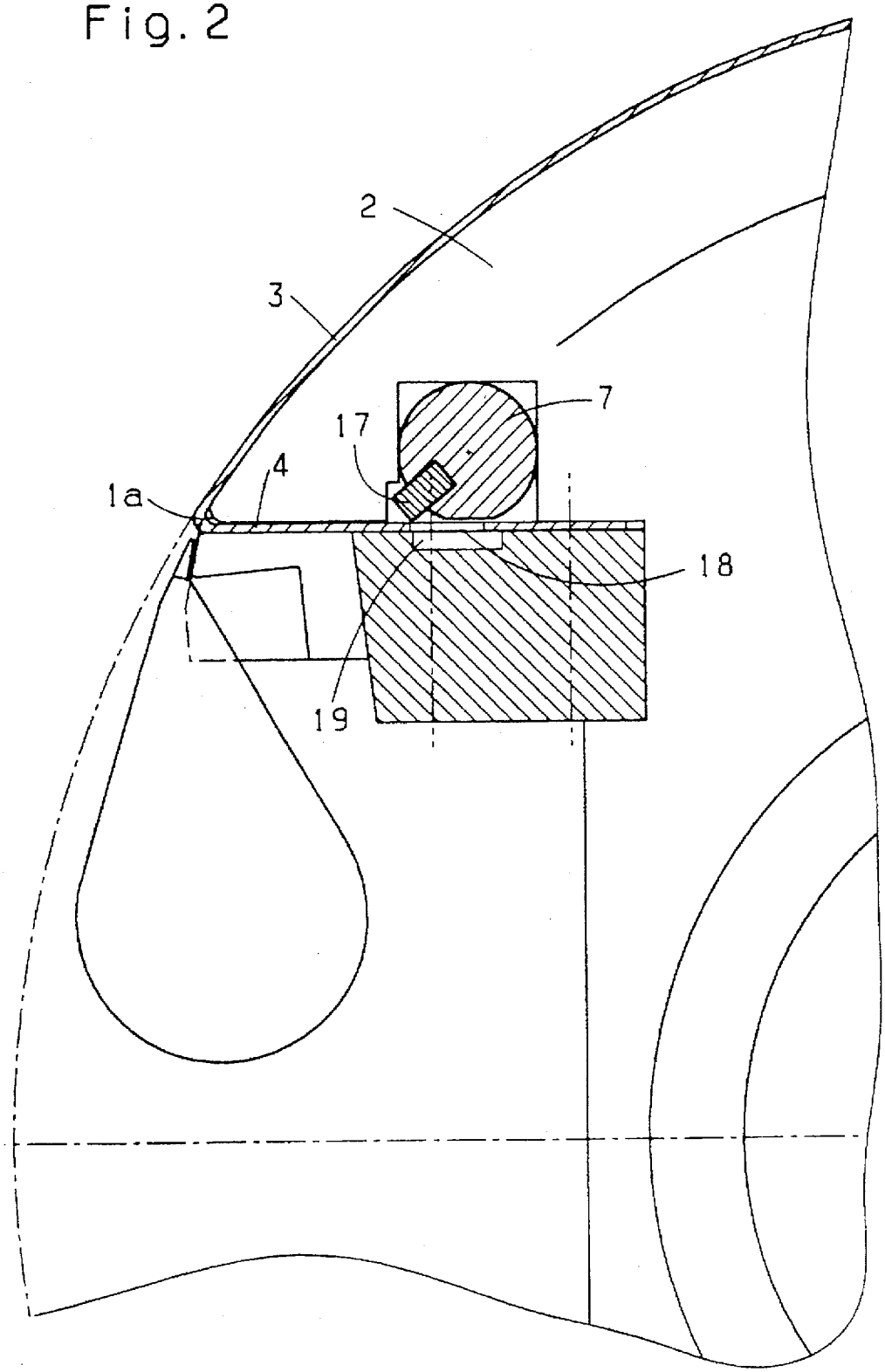
FIG. 2 is a cross-sectional view like that of FIG. 1 of a another embodiment of the device according to the invention in an operating phase thereof wherein it is unclamped.
Figure 3:
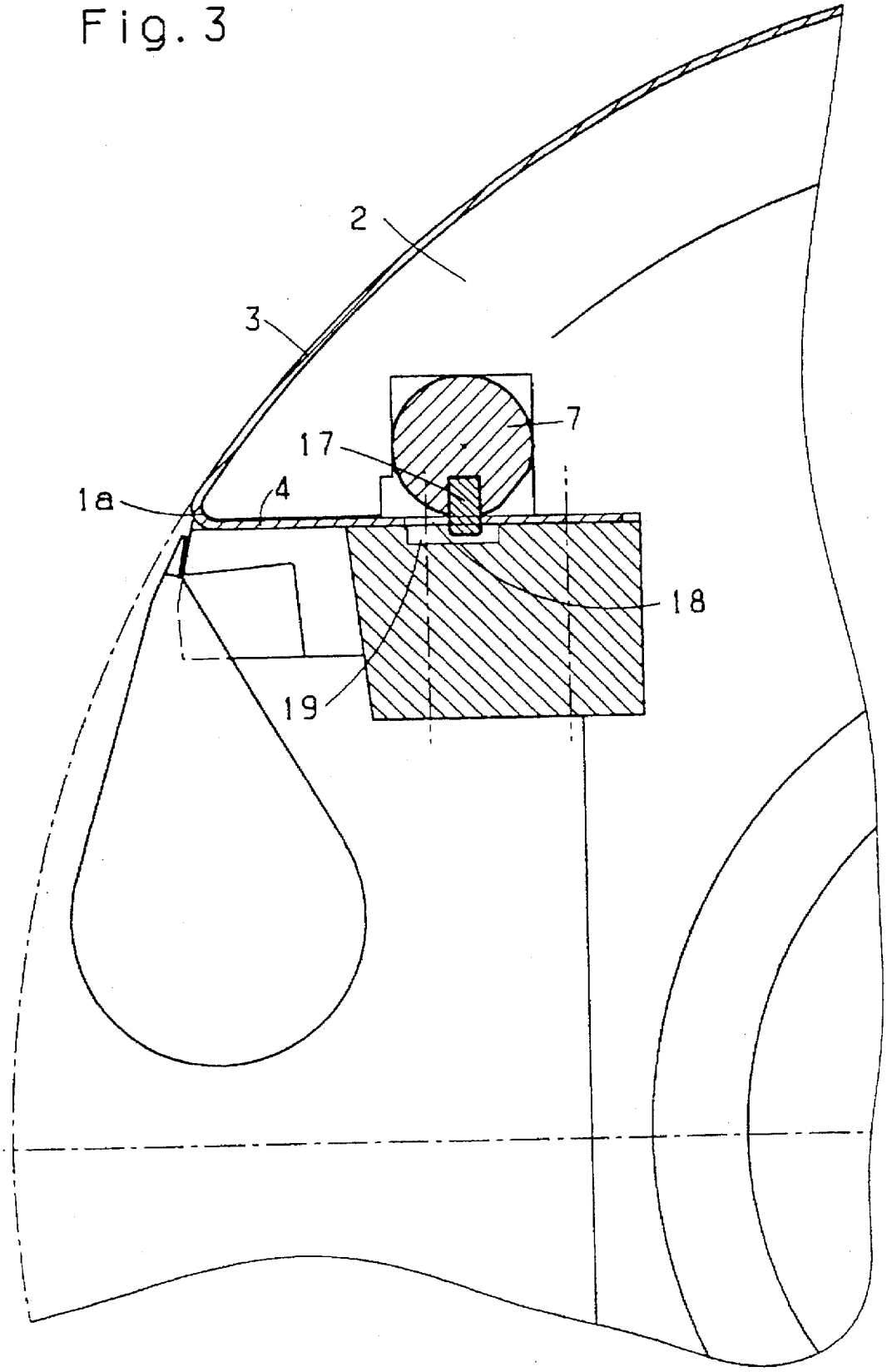
FIG. 3 is a view like that of FIG. 2 showing the other embodiment of the device according to the invention in an operating phase wherein it is in a clamped position.

Another embodiment offering a deviating solution is illustrated in FIGS. 2 and 3. In this specimen embodiment, the clamping bar 7 is also constructed as a rolling body or a rotating body with a round cross-section, and is rotatably mounted in the cylinder 2. Several ridge-type or comblike projections 17 are provided at the circumference of the clamping bar 7, the projections 17 engaging in one or more cutouts 18 formed in the bent-away end of the packing 3, when the clamping bar 7 is turned. During the tensioning process, as viewed in the turning direction, the leading edge of the projection 17 provided at the circumference of the clamping bar 9 comes into contact with a limiting surface defining the cutout 18 formed in the bent-away portion 4 so that tensioning forces are exerted onto the packing 3. A recess 19 formed in the cylinder 2 prevents the projection 17 from contacting the cylinder 2. According to the description of FIG. 1, adjusting drives, for example, adjusting screws or worm drives are suitable for turning the clamping bar 7. FIG. 2 shows the clamping bar 7 in a released position, and FIG. 3 shows it in a clamped position.

According to a simplified embodiment, the clamping bar 7 may possibly be disposed at the circumference of a body which, under the action of a force, may be rotated in a bearing provided in the cylinder 2, the axis of rotation of the body extending approximately parallel to the bent-away portion 4. If necessary, the clamping bar 7 may be made of a material which is of limited elasticity and has a high coefficient of friction.

We claim:

1. A clamping and pulling device for cylinder packings in a printing press, the device having gripper elements disposed in a cylinder gap extending axially at a circumference of a cylinder, and power elements for actuating the gripper elements to grip and firmly hold an end of a respective packing extending around an edge defining the gap and into the gap and, when actuated by the power elements, for pulling the cylinder packing around the edge defining the gap into the gap, comprising abutments on the cylinder, the gripper elements being formed of two clamping bars having respective opposing clamping jaws braced against said abutments, respectively, and, in an angular position defined by said abutments on the cylinder and the arrangement of said clamping jaws at a bent-away portion of the cylinder packing, being disposed with a vertex directed opposite to a tensioning direction, tensioning forces of a respective power element serving to load at least one of said clamping bars in the direction of a mutually extended position of said two clamping bars.

2. The clamping and pulling device according to claim 1, wherein said one clamping bar engages under the other clamping bar and is braced against a spring acting in a direction opposite to the direction in which the respective power element acts.

3. The clamping and pulling device according to claim 2, wherein said one clamping bar has a hook-shaped cross section and has a hooklike tip With which said one clamping bar is braced against the other clamping bar at a side thereof located opposite one of said abutments, said hooklike tip embracing an edge of a border of the bent-away portion of the cylinder packing lying between respective surfaces of said clamping jaws.

4. The clamping and pulling device according to claim 3, wherein the other clamping bar braced against said hook tip of said one clamping bar is loaded by a spring considerably weaker than said spring against which said one clamping bar is braced, said last-mentioned spring being disposed underneath said one clamping bar.

5. The clamping and pulling device according to claim 1, including adjusting elements for movably disposing at least one of the two abutments in a direction opposite to the respective other abutment.

6. The clamping and pulling device according to claim 2, wherein the respective power element acting upon said one clamping bar is a tightening screw.

7. A clamping and pulling device for cylinder packings in a printing press, the device having gripper elements disposed in a cylinder gap extending axially at a circumference of a cylinder, and power elements for actuating the gripper elements to grip and firmly hold an end of a respective packing extending around an edge defining the gap and into the gap and, when actuated by the power elements, for pulling the cylinder packing around the edge defining the gap into the gap, the gripper elements including a clamping bar subjectible to tensioning forces and rotatably mounted in a recess formed in the cylinder, the clamping bar having at least one projection at the circumference thereof for engaging, respectively, in at least one cutout formed in a bent-away portion of the cylinder packing and behind a projection of said bent-away portion in the tensioning direction, as the case may be, comprising a screw drive coupled with the clamping bar.

8. The clamping and pulling device according to claim 7, wherein the clamping bar has a round cross section, and said screw drive is formed of a worm transmission having a worm mounted in the cylinder so as to be rotatable by a tool, said worm transmission also having a worm wheel connected to the clamping bar.

* * * * *